US011821615B2

(12) United States Patent
Bukkems et al.

(10) Patent No.: US 11,821,615 B2
(45) Date of Patent: Nov. 21, 2023

(54) SYSTEM COMPRISING LUMINESCENT MATERIAL AND TWO-PHASE COOLING DEVICE

(71) Applicant: SIGNIFY HOLDING B.V., Eindhoven (NL)

(72) Inventors: Peter Johannes Martinus Bukkems, Deurne (NL); Olexandr Valentynovych Vdovin, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 18/019,586

(22) PCT Filed: Jul. 21, 2021

(86) PCT No.: PCT/EP2021/070337
§ 371 (c)(1),
(2) Date: Feb. 3, 2023

(87) PCT Pub. No.: WO2022/033818
PCT Pub. Date: Feb. 17, 2022

(65) Prior Publication Data

US 2023/0296236 A1 Sep. 21, 2023

(30) Foreign Application Priority Data

Aug. 11, 2020 (EP) ..... 20190428

(51) Int. Cl.
*F21V 29/502* (2015.01)
*F21V 23/04* (2006.01)
(Continued)

(52) U.S. Cl.
CPC ..... *F21V 29/502* (2015.01); *F21K 9/64* (2016.08); *F21V 23/0457* (2013.01);
(Continued)

(58) Field of Classification Search
CPC ..... F21V 29/502; F21V 29/503; F21V 29/51; F21V 29/70; F21V 29/71; F21V 29/713; F21V 29/89
See application file for complete search history.

(56) References Cited

U.S. PATENT DOCUMENTS

2009/0175041 A1* 7/2009 Yuen ..... F21V 3/061 362/373
2009/0195186 A1* 8/2009 Guest ..... H05B 45/3577 313/11

(Continued)

FOREIGN PATENT DOCUMENTS

CN 104048182 A 9/2014
CN 106907647 A * 6/2017 ..... F21S 45/40

(Continued)

*Primary Examiner* — Alexander K Garlen

(57) ABSTRACT

The invention provides a system (1000) comprising (i) a luminescent body (200) and (ii) a two-phase cooling device (400), wherein the two-phase cooling device (400) has a device wall (410), wherein the device wall (410) defines an chamber (450), wherein the device wall (410) comprises a tapering section (405) comprising a contact region (406), wherein the tapering section (405) tapers to the contact region (406), wherein the luminescent 5 body (200) is thermally coupled to the contact region (406), and wherein the device wall (410) has a first thickness d1 at the contact region (406), wherein d1 is selected from the range of 0.15-0.35 mm.

15 Claims, 5 Drawing Sheets

(51) Int. Cl.

| | |
|---|---|
| ***F21V 29/51*** | (2015.01) |
| ***F21K 9/64*** | (2016.01) |
| ***F21V 29/70*** | (2015.01) |
| ***F21Y 115/30*** | (2016.01) |
| ***F21Y 115/10*** | (2016.01) |

(52) U.S. Cl.
CPC ..... *F21V 29/51* (2015.01); *F21V 29/70* (2015.01); *F21Y 2115/10* (2016.08); *F21Y 2115/30* (2016.08)

(56) References Cited

U.S. PATENT DOCUMENTS

2009/0278460 A1* 11/2009 Chen ..... F21V 29/76 372/5
2010/0117534 A1* 5/2010 Chen ..... F21V 29/51 257/E33.059
2010/0264800 A1* 10/2010 Liu ..... F21V 19/0055 313/46
2011/0169394 A1* 7/2011 Chowdhury ..... F21V 29/506 313/504
2011/0298350 A1* 12/2011 van de Ven ..... F21V 29/80 165/185
2012/0161626 A1* 6/2012 van de Ven ..... F21V 29/773 313/317
2012/0287954 A1 11/2012 Saruwatari et al.
2012/0307493 A1* 12/2012 Betsuda ..... F21V 29/77 362/249.02
2012/0320591 A1* 12/2012 Liao ..... F21V 29/77 362/249.02
2013/0039057 A1* 2/2013 Lee ..... F28D 15/04 362/235
2013/0049041 A1 2/2013 Ramer et al.
2019/0277486 A1 9/2019 Nakao et al.
2020/0355328 A1* 11/2020 Bukkems ..... F21S 8/085

FOREIGN PATENT DOCUMENTS

WO 2018099801 A1 6/2018
WO 2020078790 A1 4/2020
WO WO-2020173731 A1 * 9/2020 ..... F21K 9/23

* cited by examiner

SYSTEM COMPRISING LUMINESCENT MATERIAL AND TWO-PHASE COOLING DEVICE

CROSS-REFERENCE TO PRIOR APPLICATIONS

This application is the U.S. National Phase application under 35 U.S.C. § 371 of International Application No. PCT/EP2021/070337, filed on Jul. 21, 2021, which claims the benefit of European Patent Application No. 20190428.1, filed on Aug. 11, 2020. These applications are hereby incorporated by reference herein.

FIELD OF THE INVENTION

The invention relates to a system comprising a luminescent body and a two-phase cooling device. The invention further relates to a light generating system comprising the system.

BACKGROUND OF THE INVENTION

Systems comprising a luminescent body and a two-phase cooling device are known in the art. For instance, US2013049041A1 describes a thermal conductivity and phase transition heat transfer mechanism incorporating an active optical element. Examples of active optical elements include various phosphor materials for emitting light, various electrically driven light emitters and various devices that generate electrical current or an electrical signal in response to light. The thermal conductivity and phase transition between evaporation and condensation, of the thermal conductivity and phase transition heat transfer mechanism, cools the active optical element during operation. At least a portion of the active optical element is exposed to a working fluid within a vapor tight chamber of the heat transfer mechanism. The heat transfer mechanism includes a member that is at least partially optically transmissive to allow passage of light to or from the active optical element and to seal the chamber of the heat transfer mechanism with respect to vapor contained within the chamber.

SUMMARY OF THE INVENTION

Removing heat from a heat source may be challenging when high powers are needed and heat generation is substantial, such as when high-intensity lighting is needed. Particularly, it may be challenging to provide sufficient cooling for a relatively small heat generating area such as in laser-based lighting using a relatively luminescent body, such as a small phosphor component. Full water systems may be limited by the amount of water and pressure in the liquid stage that can pass by a hot surface.

The prior art may describe electronic components, such as a driver, in a housing, wherein otherwise empty space in the housing is filled up with thermal interface materials However, thermal interface materials, such as polymer-based composites and graphite type thermal interface materials, may typically have a maximum thermal conductivity up to 2000 W/mK.

Two-phase devices, such as heat pipes and vapor chambers, may transfer heat between two locations based on both thermal conductivity and phase transition. In particular, a cooling liquid may turn into vapor by absorbing heat at a heat source, may travel along the two-phase cooling device to a heat exchanger, where the vapor may condense to a liquid and release latent heat. However, systems comprising such two-phase devices, such as systems further comprising light emitting devices, may still be thermally limited, thereby limiting the (max) power at which the system may be operated.

Hence, it is an aspect of the invention to provide an alternative system, which preferably further at least partly obviates one or more of above-described drawbacks. The present invention may have as object to overcome or ameliorate at least one of the disadvantages of the prior art, or to provide a useful alternative.

Hence, in a first aspect the invention may provide a system comprising a heat source, especially a luminescent body, and a two-phase cooling device (also "two-phase device"). The two-phase cooling device may have a device wall, especially wherein the device wall defines an (elongated) chamber. The device wall may comprise a tapering section. The tapering section may comprise a contact region, especially wherein the tapering section tapers to the contact region. The contact region may be arranged at a first end along a device axis of the two-phase cooling device. In particular, the contact region may be defined by a planar region (essentially) perpendicular to the device axis. Hence, the tapering section may taper to the first end. The heat source, especially the luminescent body, may be thermally coupled to the contact region. In embodiments, the device wall may have a first thickness $d_1$ at the contact region, especially wherein $d_1$ is selected from the range 0.05-0.4 mm, especially from the range of 0.1-0.4 mm, such as from the range of 0.15-0.35 mm. The first thickness $d_1$ may especially be defined along the device axis.

In specific embodiments, the system may comprise (i) a luminescent body and (ii) a two-phase cooling device, wherein the two-phase cooling device has a device wall, wherein the device wall defines a chamber, wherein the device wall comprises a tapering section comprising a contact region, wherein the tapering section tapers to the contact region, wherein the luminescent body is thermally coupled to the contact region, and wherein the device wall has a first thickness $d_1$ at the contact region, wherein $d_1$ is selected from the range of 0.15-0.35 mm.

The system of the invention may provide the benefit that the heat transfer from the heat source, especially from the luminescent body, to (liquid in) the two-phase cooling device may be improved due to the relatively thin contact region, while retaining sufficient (mechanical) stress resistance. For example, heat pipes may generally have wall thicknesses of around 0.4 mm or thicker such that the heat pipe can withstand the (mechanical) stresses the heat pipe may be exposed to due to the heat transfer. The local reduction of thickness of the two-phase cooling device of the invention may result in a low temperature difference ($\Delta T$) between a first side and a second side of the contact region, which may improve the overall heat transfer facilitated by the two-phase cooling device. The first side (of the contact region) may especially be facing the chamber, whereas the second side (of the contact region) may especially be facing the heat source, especially the luminescent body.

In particular, the tapering section may reduce the cross-sectional area of the two-phase cooling device towards the contact region. Hence, the area of the contact region may be relatively small, but may allow more heat transfer at a lower $\Delta T$, due to the reduced thickness. The tapering section may facilitate transferring vapor up from the contact region, especially along a device axis, while allowing water to flow to the contact region along (tapering) device walls. In particular, the two-phase cooling device may be functionally coupled to a heat exchanger via a second contact region opposite to the contact region (see below), wherein the second contact region has a larger area than the contact area (due to the tapering), such that liquid/surface limitations for heat transfer to a heat exchanger may be reduced. In particular, where in typical two-phase cooling devices, such as typical heat pipes, heat may be transferred from a relative large surface to a similarly large surface, the system of the invention provides a "hot spot" on the two-phase cooling device and removes heat from the hot spot with a high power density. As the heat transfer is improved, the heat source, especially the luminescent body, may be cooled more effectively, which results in a lower temperature of the heat source at the same operational power, which further results in a reduced mechanical stress on the two-phase cooling device due to heating. Further, the heat source may be operated at a higher power, resulting in a higher brightness, while not exceeding maximal stress levels for the two-phase cooling device of the invention.

Further, the tapering section may increase the working angle of the two-phase cooling device as the tapering section may during operation guide a cooling liquid to the contact region. In particular, the tapering section, especially a V-shaped tapering section, may facilitate tilting of the two-phase cooling device while directing liquid to flow back to the contact region due to gravity whereas the wick of typical two-phase cooling devices may tend to dry out relatively quickly with high local heat loads.

In embodiments, the invention may provide a system comprising a heat source, especially a luminescent body. The term "heat source" may herein refer to an object that, during operation, generates heat. In particular, it may refer to an object that may require cooling for sustained operation. For example, in embodiments, the heat source may comprise an element selected from the group comprising a luminescent body, a control system, a driver, a printed circuit board (PCB), and a light emitting device (such as a LED or diode laser).

For instance, in embodiments, the system may comprise a plurality of two-phase cooling devices, wherein the plurality of cooling devices are thermally coupled to a (single) PCB, especially thermally coupled to different PCB components of the PCB. In such embodiments, the plurality of cooling devices may especially have different values for $d_1$, as different PCB components may require different amounts of heat transfer.

In particular, the heat source may be a luminescent body. The luminescent body may comprise a luminescent material, especially a phosphor. In embodiments, the luminescent body may comprise a layer, a multilayer, or a sintered body, especially a ceramic body. The term "luminescent material" may herein refer to a material configured to convert light source radiation (see below) into luminescent material radiation, which conversion may generally be accompanied by (substantial) heat production. In specific embodiments, the luminescent body comprises a ceramic body or single crystal.

The invention may herein for explanatory purposes primarily be described with regards to embodiments wherein the heat source comprises a luminescent body. However, it will be clear to the person skilled in the art that the invention is not limited to such embodiments.

The system may further comprise a two-phase cooling device. Two-phase cooling devices may be devices that transfer heat between two locations based on both thermal conductivity and phase transition. In particular, liquid, such as water (e.g. for a copper device) or acetone (e.g. for an aluminum device), may be added to the two-phase cooling device and the two-phase cooling device may be vacuum sealed. When heat is applied to one area of the two-phase cooling device, the liquid may turn to vapor and move to an area of lower pressure where it cools and returns to liquid form whereupon it moves back to the heat source.

In embodiments, the two-phase cooling device may especially comprise a heat pipe or a vapor chamber element, especially a heat pipe, or especially a vapor chamber element. Vapor chamber elements and heat pipes are known in the art and may be based on essentially the same principle. A difference between the heat pipe and the vapor chamber element may be that the heat pipe may typically have an essentially rod-shaped shape, whereas the vapor chamber element may in general have a planar shape. In particular, the vapor chamber element may include two essentially planar plates at a relative short distance (such as up to 5 mm). Further, for the vapor chamber element the hot spot may relatively freely be chosen, whereas for a heat pipe there is generally a hot and cold side at the opposing sides of the rod, such as at the bases of a cylinder-shaped heat pipe.

The two-phase cooling device may have a device wall, especially wherein the device wall defines an elongated chamber. In particular, the device wall may enclose the chamber. The device wall may generally be airtight. The device wall may especially comprise a thermally conductive material selected from the group comprising copper, aluminum, stainless steel, titanium, nickel, Monel, tungsten, niobium, tungsten, molybdenum and Inconel. In particular, a medium temperature two-phase cooling device may comprise nickel, and a high temperature two-phase cooling device may comprise one or more of Monel, tungsten, niobium, molybdenum and Inconel. In embodiments, also material combinations, of e.g. two or more metals, may be applied, such as alloys. A two-phase cooling device configured for functional coupling to a luminescent body may especially have a device wall comprising a thermally conductive material selected from the group comprising copper, aluminum, stainless steel, nickel and titanium, which may be particularly suitable for the operational temperatures of such a system.

In further embodiments, the device wall may comprise a material with low thermal expansion coefficient, especially a ceramic material, more especially (quartz) glass. In particular, a low thermal expansion coefficient may result in a lower mechanical stress, which may in turn enable (locally) reducing the thickness further. For instance, quarts glass may have a thermal expansion close to 0 allowing to heat the quartz glass at one side and extremely cool it down on the other side without destroying the glass, which may facilitate obtaining a smaller $\Delta T$.

The chamber may especially be an elongated chamber, especially wherein an axis of elongation of the chamber is perpendicular to the contact region. The device axis may especially be parallel to the axis of elongation of the chamber.

The two-phase cooling device, especially the device wall, may comprise a first section. The first section may comprise a contact region at a first end (of the two-phase cooling device) along a device axis of the two-phase cooling device. The first section may comprise a first wall segment and a second wall segment, wherein the first wall segment defines the contact region and is arranged (essentially) perpendicularly to the device axis. In embodiments, the second wall segment may especially be parallel to the device axis. In further embodiments, the first section may be a tapering section.

Hence, the two-phase cooling device, especially the device wall, may comprise a tapering section. The tapering section may taper to the contact region. Hence, a cross-section of the two-phase cooling device, especially of the chamber, at the contact region and perpendicular to the device axis may have a smaller area than a second cross-section of the two-phase cooling device at the end of the tapering section opposite of the contact region and perpendicular to the device axis. In particular, a cross-section at the contact area may have the smallest area of all cross-sections of the two-phase cooling device perpendicular to the device axis.

The contact region may especially be arranged at a first end (of the two-phase cooling device) along a device axis of the two-phase cooling device. The contact region may have a planar shape, especially wherein the contact region is arranged perpendicular to the device axis. In particular, the tapering section may comprise the contact region. Hence, the tapering section may comprise a first wall segment and a second wall segment, wherein the first wall segment defines the contact region and is arranged (essentially) perpendicularly to the device axis, and wherein the second wall segment is arranged at a tapering angle $\alpha t$ relative to the device axis, wherein $20 \leq \alpha_t \leq 60$. In embodiments, the tapering angle $\alpha t$ may essentially be constant, such as constant along at least 80% of length of the second wall section (along the device axis). However, in further embodiments, the tapering angle $\alpha t$ may vary along the tapering section, especially along the device axis.

In embodiments, the heat source, especially the luminescent body, may be thermally coupled to the contact region, i.e., the heat source, especially the luminescent body, may be in thermal contact with the contact region. Especially, the term "thermal contact" may indicate that an element can exchange energy through the process of heat with another element. In embodiments, thermal contact may be achieved between two elements when the two elements are arranged relative to each other at a distance of equal to or less than about 10 μm, though larger distances, such as up to 100 μm may be possible. The shorter the distance, the better the thermal contact may be. Especially, the distance may be 10 μm or less, such as 5 μm or less. The distance may be the distanced between two respective surfaces of the respective elements. The distance may be an average distance. For instance, the two elements may be in physical contact at one or more, such as a plurality of positions, but at one or more, especially a plurality of other positions, the elements are not in physical contact. For instance, this may be the case when one or both elements have a rough surface. Hence, in embodiments in average the distance between the two elements may be 10 μm or less (though larger average distances may be possible, such as up to 100 μm). In embodiments, the two surfaces of the two elements may be kept at a distance with one or more distance holders.

Herein, the term "thermal contact" may especially refer to an arrangement of elements that may provide a thermal conductivity of at least about 10 W/mK, such as at least 20 W/mK, such as at least 50 W/mK. In embodiments, the term "thermal contact" may especially refer to an arrangement of elements that may provide a thermal conductivity of at least about 150 W/mK, such as at least 170 W/mK, especially at least 200 W/mK. In embodiments, the term "thermal contact" may especially refer to an arrangement of elements that may provide a thermal conductivity of at least about 250 W/mK, such as at least 300 W/mK, especially at least 400 W/mK.

An air gap between the contact region and the heat source, especially the luminescent body, may negatively impact heat transfer. Hence, in embodiments, the system may comprise a thermal paste arranged between the contact region and the luminescent body. The thermal paste may especially be in thermal contact with the contact region and with the luminescent body. The thermal paste may especially provide a thermal conductivity of at least 0.1 W/mK, especially of at least 1 W/mK, such as of at least 2 W/mK. In embodiments, the thermal paste may have a thermal conductivity selected from the range of 0.1-15 W/mK, such as from the range of 0.1-5 W/mK.

Hence, the two-phase cooling device may be arranged to transport heat away from the heat source, especially away from the luminescent body.

In embodiments, the device wall may have has a first thickness $d_1$ at the contact region, especially wherein $d_1$ is $\leq 0.4$ mm. In further embodiments, $d_1$ may be selected from the range of 0.05-0.4 mm, such as from the range of 0.1-0.4 mm, especially from the range of 0.15-0.35 mm. The first thickness $d_1$ may especially be defined along the device axis. In particular, a low $d_1$ may enable providing a low power system with a particularly low delta T, which device may be able to operate at higher ambient temperature without overheating the heat source.

In general, two-phase cooling devices may typically include a wick structure (sintered powder, mesh screens, and/or grooves) applied to the inside wall(s) of an enclosure (tube or planar shape). However, the two-phase cooling device of the invention, especially the chamber, may be hollow, i.e., the two-phase cooling device may be (essentially) devoid of a wick structure. The wick structure in a two-phase device may typically serve to provide a capillary effect such that the liquid, once condensed at a cool side of the two-phase device, flows back to a hot side of the two-phase device. However, the wick structure may limit overall heat transfer of the two-phase device.

Hence, the two-phase device of the invention may generally be hollow. In particular, as gravity pulls on the liquid, once condensed at the cool side, the tapering section of the two-phase device may guide the liquid to the contact region.

In embodiments wherein the two-phase cooling device comprises a vapor chamber element, the vapor chamber element may comprise a vapor chamber at least partly defined by two parallel configured plates, i.e., in embodiments, the vapor chamber element may comprise a first plate and a second plate, especially with a vapor chamber in between. The first plate and the second plate may especially be arranged in parallel. Hence, in embodiments the vapor chamber may be defined by at least a first plate and a second plate having an average plate distance equal to a chamber height, i.e., the first plate and the second plate may define the chamber height. At the edges of the plates, the plates may be welded together to provide a closed chamber. The plates may also define, together with one or more edges, the vapor chamber. In embodiments, over a substantial part of the first plate and a substantial part of the second plate, the plates may be configured parallel. For instance, over at least 50%, such as at least 80%, like at least 90% of an area of the first plate, and over at least 50%, such as at least 80%, like at least 90% of an area of the second plate, the plates may be configured parallel. Hence, over a substantial part of the first plate and a substantial part of the second plate, the distance between the plates may essentially not vary. The first plate and the second plate may especially approximate a (same) rectangular shape, such as a rounded rectangular shape. In particular, the term "parallel" with respect to the parallel configured plates may herein refer to the two plates having essentially the same (closest) distance from one another at over a substantial parts of the plates. Hence, the two plates may, for example, be bent, especially with the same radius of curvature, and still be considered parallel. Hence, in such embodiments, the (elongated) chamber may be the vapor chamber.

In embodiments, the device wall may be shaped from a single piece (of material).

In embodiments, the chamber may have a chamber volume of at least (about) 1 $mm^3$, such as at least 0.5 $cm^3$, especially at least (about) 1 $cm^3$, such as at least about 2 $cm^3$, especially at least about 5 $cm^3$, such as about 10 $cm^3$. In embodiments, the chamber volume may be at most (about) 1000 $cm^3$, such as at most 500 $cm^3$, especially at most 100 $cm^3$, such as at most 25 $cm^3$, even more especially at most (about) 10 $cm^3$. In particular, when the chamber volume is large it may further serve as an (auxiliary) heat sink.

In embodiments, the system may further comprises a light generating device, especially a laser-based light generating device. The (laser-based) light generating device may be configured to provide (laser) light source light to the luminescent body, especially via one or more optical elements. Hence, the light generating device may comprise a laser. In specific embodiments, the light generating device comprises a light source, wherein the light source comprises a laser, like a diode laser. In specific embodiments, the light generating device is a laser.

The luminescent body may be configured to convert (at least part of) the (incident) light source light into luminescent material light. In particular, the luminescent body may comprise luminescent material configured to convert at least part of the (incident) light source light into luminescent material light.

In embodiments, the two-phase cooling device, especially the tapering section, may taper to the contact region at a tapering angle $\alpha_t$. The tapering angle $\alpha_t$ may especially be the (smallest) angle between two planes defined by the device wall, especially wherein a first plane of the two planes is defined by the tapering section, and especially wherein a second of the two planes is parallel to the device axis. Hence, the tapering angle $\alpha_t$ may also be (defined as) the (smallest) angle between a plane defined by the tapering section and the device axis.

In embodiments, at least part of the two-phase cooling device, especially the second section, may have a cylindrical shape. In further embodiments, the tapering section may have a shape approximating a conical frustum. In such embodiments, the first plane may especially be defined parallel to (i) a shortest line spanning between a top surface and a bottom surface of the conical frustum and running along the surface of the conical frustum and (ii) the tangent to the conical frustum at a point along this shortest line. In further embodiments, the contact region may have a circular shape.

In further embodiments, the second section may also have right prismatic shape, such as a right rectangular prism or a right hexagonal prism. In further embodiments, the tapering section may have a pyramid shape, such as a pyramid shape with four or six lateral faces. In further embodiments, the contact region may have a regular polygonal shape, such as a square or a hexagon.

In particular, the tapering section may have a shape selected such that it provides the shape of the second section at one side of the tapering section, while providing the shape of the contact region at the other side of the tapering section. For example, the tapering section may taper from a cylindrical second section to a square contact region.

In embodiments, the (average) tapering angle $\alpha_t$ may be selected from the range of 10°-70°, especially from the range of 20°-60°, such as from the range of 25°-55°. In further embodiments, $\alpha_t \geq 10°$, such as ≥15°, especially ≥20°, such as ≥25°, especially ≥30°. In further embodiments $\alpha_t \leq 70°$, such as ≤65°, especially ≤60°, such as ≤55°, especially ≤50°.

There may be competing reasons to select a small or a large tapering angle $\alpha_t$ for the two-phase device. In particular, a larger tapering angle may result in a larger working angle of the two-phase device, i.e., a larger tapering angle $\alpha_t$ may result in a larger tolerance of the two-phase device towards a deviation from vertical operation. However, a smaller tapering angle may result in an improved flow of (cooling) liquid to the contact region. Hence, the tapering angle $\alpha_t$ may especially be selected from the range of 25-65, such as from the range of 20-60. Such tapering angles at may be particularly advantageous in view of the competing benefits.

In further embodiments, the tapering section may taper (towards the contact region) at an (essentially) constant tapering angle $\alpha_t$. Hence, the tapering angle $\alpha_t$ may be constant along at least 60% of the tapering section, such as along at least 70%, especially along at least 80%, such as at along at least 90%.

In further embodiments, the tapering section may taper towards the contact region) at a varying angle. Hence, the tapering angle $\alpha_t$ may especially be an average tapering angle at (of the tapering section).

During operation of the system, bubbles (vapor) may form on the device wall, which may locally reduce heat transfer. In particular, if bubble form on (or near) the contact region, thermal transfer from the heat source to the two-phase device may be reduced. Hence, in embodiments, the two-phase cooling device, especially the tapering section, may internally have a smooth surface. In particular, in embodiments, the device wall may have a first face and a second face, wherein the first face is directed to the chamber and the second face is directed to the external of the two-phase cooling device, wherein at least part of the first face comprised by the tapering section, especially at least part of the first face comprised by the contact region, has a surface roughness ≤120 nm, especially ≤60 nm, such as ≤40 nm, especially ≤25 nm, such as ≤15 nm, especially ≤10 nm, such as ≤5 nm, especially ≤3 nm, such as ≤2 nm.

The surface (of the first face) may be rougher at other parts of the two-phase cooling device. Hence, in further embodiments, at least part of the first face not comprised by the tapering section, especially at least part of the first face not comprised by the contact region, may have a larger surface roughness than the at least part of the first face comprised by the tapering section (or by the contact region).

In embodiments, the device wall may comprise a second section. In particular, the tapering section and the second section may together define the device wall, i.e., the device wall may consist of the tapering section and the second section. The device wall may have a second thickness $d_2$ selected from the range of ≥0.4 mm at the second section, especially selected from the range 0.4-3 mm, such as from the range of 0.4-2 mm, especially from the range of 0.4-1 mm, such as from the range of 0.4-0.6 mm.

Hence, the device wall may be thicker at the second section than at the contact region. The two-phase cooling device may generally have a second thickness $d_2$ to increase tolerance to material stresses, but may locally, especially at the contact region, have a reduced thickness to increase thermal transfer at the contact region, especially between the heat source and the contact region, such as between the luminescent body and the contact region. In particular, $d1/d2 \leq 0.9$, especially $\leq 0.8$, such as $\leq 0.7$, especially $\leq 0.6$, such as $\leq 0.5$. In further embodiments $d1/d2 \geq 0.3$, such as $\geq 0.4$, especially $\geq 0.5$, such as $\geq 0.6$. Hence, in further embodiments, at least part of the device wall at the tapering section may have the second thickness $d_2$.

In embodiments, the luminescent body may have a body thickness $d_b$, especially perpendicular to a plane defined by the contact region, wherein the body thickness $d_b \leq 2$ mm, such as $\leq 1$ mm, especially $\leq 0.8$ mm, such as $\leq 0.6$ mm, especially $\leq 0.5$ mm.

In embodiments, the contact region may have a contact area $a_c$ selected from the range of 1-100 $mm^2$, such as from the range of 5-60 $mm^2$, especially from the range of 10-30 $mm^2$. In further embodiments, $a_c \geq 0.1$ $mm^2$, such as $a_c \geq 0.5$ $mm^2$, especially $a_c \geq 1$ $mm^2$ such as $a_c \geq 2$ $mm^2$, especially $a_c \geq 5$ $mm^2$, such as $a_c \geq 10$ $mm^2$, especially $a_c \geq 15$ $mm^2$. In further embodiments, $a_c \leq 150$ $mm^2$, such as $a_c \leq 100$ $mm^2$, especially $a_c \leq 80$ $mm^2$, such as $a_c \leq 60$ $mm^2$, especially $a_c \leq 50$ $mm^2$, more especially $a_c \leq 40$ $mm^2$, such as $a_c \leq 30$ $mm^2$, especially $a_c \leq 20$ $mm^2$.

As described above, the two-phase cooling device may have a device axis. The device axis may be arranged perpendicular to the contact region, i.e., to a plane defined by the wall section at the contact region.

The contact area $a_c$ may especially be a cross-sectional area (of the two-phase cooling device) perpendicular to the device axis.

In embodiments, the two-phase cooling device may have an average cross-sectional area $a_m$ perpendicular to the device axis, wherein $a_c \leq 0.8*a_m$, such as $a_c \leq 0.7*a_m$, especially $a_c \leq 0.6*a_m$, such as $a_c \leq 0.5*a_m$. In further embodiments, $a_c \geq 0.1*a_m$, such as $a_c \geq 0.2*a_m$, especially $a_c \geq 0.3*a_m$, such as $a_c \geq 0.5*a_m$.

In further embodiments, the second section may have an (average) cross-sectional area $a_2$ perpendicular to the device axis, wherein $a_c \leq 0.8*a_2$, such as $a_c \leq 0.7*a_2$, especially $a_c \leq 0.6*a_2$, such as $a_c \leq 0.5*a_2$. In further embodiments, $a_c \geq 0.1*a_2$, such as $a_c \geq 0.2*a_2$, especially $a_c \geq 0.3*a_2$, such as $a_c \geq 0.5*a_2$.

The contact area $a_c$ may especially have a similar area as a face of the heat source, especially a face of the luminescent body, facing the contact area. Hence, in embodiments, the heat source, especially the luminescent body, may have a contact area an selected from the range of 1-100 $mm^2$, such as from the range of 5-60 $mm^2$, especially from the range of 10-30 $mm^2$. In further embodiments, $a_h \geq 0.1$ $mm^2$, such as $a_h \geq 0.5$ $mm^2$, especially $a_h \geq 1$ $mm^2$ such as $a_h \geq 2$ $mm^2$, especially $a_h \geq 5$ $mm^2$, such as $a_h \geq 10$ $mm^2$, especially $a_h \geq 15$ $mm^2$. In further embodiments, $a_h \leq 150$ $mm^2$, such as $a_h \leq 100$ $mm^2$, especially $a_h \leq 80$ $mm^2$, such as $a_h \leq 60$ $mm^2$, especially $a_h \leq 50$ $mm^2$, more especially $a_h \leq 40$ $mm^2$, such as $a_h \leq 30$ $mm^2$, especially $a_h \leq 20$ $mm^2$. In particular, in embodiments, $0.8 \leq a_h/a_c \leq 1.2$, such as $0.9 \leq a_h/a_c \leq 1.1$.

Two-phase cooling devices may generally be operated at a low gas pressure, i.e., a low gas pressure in the chamber. In particular, two-phase cooling devices may be operated at the evaporation pressure of a cooling liquid in the chamber, i.e., the pressure at which the vapor of the liquid is in thermodynamic equilibrium with its condensed state (for a given temperature), which may typically be close to vacuum. For example, for water the evaporation pressure may be selected from the range of 0.1-0.5 bar (absolute pressure), such as about 0.2 bar. At such low pressures, the cooling liquid may evaporate easily, which may facilitate transferring heat within the two-phase cooling device.

In embodiments, the liquid may comprise water. In such embodiments, the chamber gas pressure $p_c$ in the chamber may especially be selected from the range of $\leq 0.5$ bar, such as $\leq 0.3$ bar, especially $\leq 0.2$ bar, such as $\leq 0.1$ bar. In further embodiments, the chamber gas pressure $p_c$ may be selected from the range of 0-0.5 bar, such as from the range of 0.1-0.5 bar.

Other cooling liquids may have substantially higher evaporation pressures. For example, for $CO_2$ the evaporation pressure may—at room temperature—have an evaporation pressure >5 bar. Hence, in embodiments, the chamber gas pressure $p_c \geq 1$ bar, such as $\geq 1.5$ bar, especially $\geq 2$ bar, such as $\geq 3$ bar, especially $\geq 5$ bar, such as $\geq 10$ bar. In further embodiments, the chamber gas pressure $p_c \leq 100$ bar, such as $\leq 50$ bar, especially $\leq 20$ bar, such as $\leq 10$ bar, especially $\leq 5$ bar.

Hence, in further embodiments, the chamber gas pressure $p_c$ may be selected to be near an evaporation pressure $p_e$ of the liquid, such as $0.8*p_e \leq p_c \leq 1.2*p_e$, especially $0.9*p_e \leq p_c \leq 1.1*p_e$. The person skilled in the art will be able to select a pressure suitable for the cooling liquid, especially to set the pressure at the evaporation pressure of the cooling liquid in view of the operational temperature.

The device wall may thus experience mechanical stress due to the relatively higher (ambient) pressure outside of the two-phase cooling device with respect to the chamber gas pressure $p_c$. Hence, in embodiments, the system may comprise a pressure control element, wherein the pressure control element is configured to control the external air pressure in the range of $0.9*p_c$-$1.3*p_c$, such as in the range of $1*p_c$-$1.2*p_c$, especially in the range of $1*p_c$-$1.1*p_c$. The two-phase cooling device of the invention may have a locally increased vulnerability to mechanical stresses due to the first thickness $d_1$ at the contact region. Hence, in particular, the contact region may be exposed to the external air pressure, wherein the pressure control element is configured to control the external air pressure (the contact region is exposed to) in the range of $0.9*p_c$-$1.3*p_e$, such as in the range of $1*p_c$-$1.2*p_c$, especially in the range of $1*p_c$-$1.1*p_c$.

In further embodiments, the pressure control element may be configured to control the external air pressure the two-phase cooling device, especially the tapering section, more especially the contact region, is exposed to.

The two-phase cooling device may have a "hot side", at which heat is transferred from a heat source, here especially from a luminescent body, to the two-phase cooling device, and a "cold side" where heat is transferred from the two-phase cooling device to a heat exchanger, especially a heat sink. Hence, in embodiments, the two-phase cooling device may comprise a second contact region. The second contact region may especially be arranged opposite of the contact region, such as at a second end of the two-phase cooling device along the device axis (A). In such embodiments, the system may further comprise or be functionally coupled to a heat exchanger, wherein the second contact region is thermally coupled to the heat exchanger. The term "second contact region" may also refer to a plurality of second contact regions.

The light generating device may also heat up during use, and it may thus be beneficial to cool the light generating device. Hence, in embodiments, the light generating device may (also) be thermally coupled to the two-phase cooling device, especially at the tapering section, such as especially at the contact region. In general, the light generating device may not heat up as much as the heat source, such as the luminescent body; hence, the second thickness may provide sufficient heat transfer to maintain a suitable temperature at the light generating device.

Excessive heat may damage the two-phase cooling device, the light generating device, and/or the luminescent body. Hence, in embodiments, the system may further comprise a control system and a temperature sensor. The temperature sensor may especially be configured to determine a temperature of the luminescent body and to provide a temperature-related signal to the control system.

In further embodiments, the temperature sensor may be configured to determine a core temperature of the heat source, especially of the luminescent body. In such embodiments, the control system may be configured to control the core temperature of the luminescent body in the range of ≤220° C., such as in the range of ≤200° C., especially in the range of ≤180°, such as in the range of ≤170°, by controlling the light generating device and/or the heat exchanger, especially by controlling the light generating device, or especially by controlling the heat exchanger.

In particular, the temperature sensor may be configured to determine a surface temperature of the heat source, especially of the luminescent body, especially a surface temperature of a surface (of the luminescent body) directed to the contact region. In such embodiments, the control system may be configured to control the (surface) temperature of the luminescent body in the range of ≤100° C., especially in the range of ≤90° C., such as in the range of ≤85° C., especially in the range of ≤80° C., such as in the range of ≤75° C., by controlling the light generating device and/or the heat exchanger, especially by controlling the light generating device, or especially by controlling the heat exchanger.

In embodiments, the system may comprise a housing. In particular, the housing may comprise the two-phase device and the luminescent body.

As indicated above, the system may comprise a light generating device. The light generating device may comprise one or more light sources. Especially, in embodiments the one or more light sources may comprise solid state light sources. For instance, the one or more light sources may comprise LEDs. The one or more light sources are configured to generate light source light, such as in embodiments LED light. The light source light may especially comprise UV light and/or blue light, such as especially UV light, or especially blue light.

The system may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, green house lighting systems, horticulture lighting, LCD backlighting, laser systems, UV cleaning systems, or electronic components.

In a specific embodiment, the light source may comprise a solid state LED light source (such as a LED or laser diode).

The term "light source" may also relate to a plurality of light sources, such as 2-20 (solid state) LED light sources. Hence, the term LED may also refer to a plurality of LEDs.

In a second aspect, the invention may provide a light generating system selected from the group of a lamp, a luminaire, a projector device, a disinfection device, and an optical wireless communication device, comprising the system according to the invention. The light generating system of the invention may, due to the improved cooling of the system, have the benefit that it may provide light source light with a particularly high intensity; it may be particularly bright.

In a further aspect, the invention may also provide the two-phase cooling device as such.

In a further aspect, the invention may provide the tapering section as such. In particular, the tapering section may be provided as a two-phase cooling device cap, especially wherein the two-phase cooling device cap is configured to be attached to a second section to provide the two-phase cooling device. Hence, in a further aspect, the invention may provide a two-phase cooling device cap comprising the tapering section.

In a further aspect, the invention may provide a method of providing the two-phase cooling device. In particular, the method may comprise closing of the two-phase cooling device. The closing of the two-phase cooling device may especially leave a single opening for filling of the chamber with a (cooling) liquid. Hence, the method may further comprise filling the chamber with a (cooling) liquid. After filling of the chamber, the two-phase cooling device may be sealed. Hence, in further embodiments, the method may comprise sealing of the two-phase cooling device.

In embodiments, the method may comprise attaching the tapering section and the second section to provide the two-phase cooling device, especially by welding the tapering section and the second section together.

In a further aspect the invention provides a two-phase cooling device obtainable with the method of the invention.

In a further aspect the invention provides a device assembly comprising the two-phase cooling device of the invention. In particular, the device assembly may comprise a heat source thermally coupled to the (contact region of the) two-phase cooling device. The heat source may especially be an electronic device.

The invention further provides a system, assembly or device, comprising two or more two-phase cooling devices, wherein at least two of the two or more two-phase cooling devices are thermally coupled to different (type of) heat sources, and wherein the at least two of the two or more two-phase cooling devices have different first thicknesses. The different (type of) heat sources may e.g. be selected from the group consisting of a luminescent body, a control system, a driver, a printed circuit board (PCB), and a light emitting device.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

FIG. 1A-D schematically depict embodiments of the system.

Figure 1A:
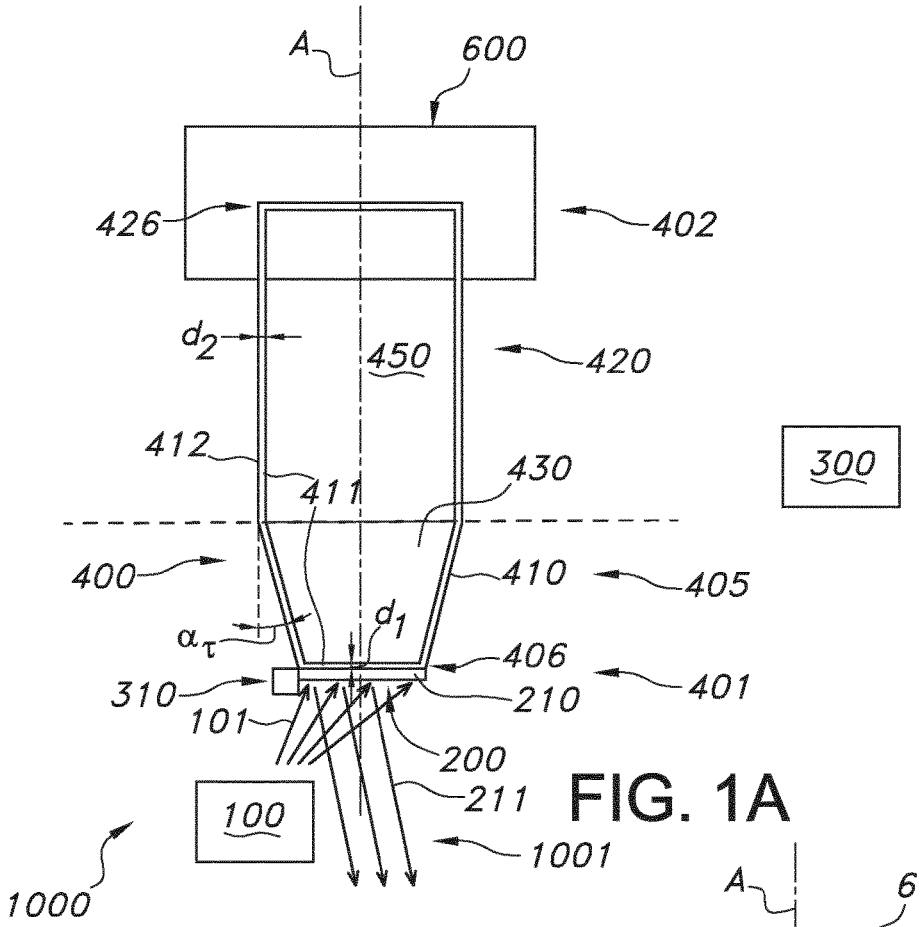
FIG. 1A-D schematically depict embodiments of the system.

FIG. 1A schematically depicts an embodiment of the system 1000 comprising (i) a heat source, especially a luminescent body 200, and (ii) a two-phase cooling device 400. The two-phase cooling device 400 may have a device wall 410. The device wall 410 may define a chamber 450 and may comprise a tapering section 405. The tapering section 405 may comprise a contact region 406 and may taper to the contact region 406. The contact region 406 may be arranged at a first end 401 of the two-phase cooling device 400 along a device axis A, wherein the device axis A may especially be perpendicular to (a plane defined by) the contact region 406. The luminescent body 200 may comprise a luminescent material 210 and may be thermally coupled to the contact region 406, especially such that heat generated by the luminescent body may be transferred to the two-phase cooling device via the contact region 406. At the contact region 406, the device wall 410 may have a first thickness $d_1$ (along the device axis A), wherein $d_1$ is selected from the range of 0.10-0.40 mm.

In the depicted embodiment, the luminescent body 200 is depicted in direct (physical) contact with the contact region 406. However, in further embodiments, the luminescent body 200 and the contact region 406 may also be spaced apart by air and/or an interconnect. Hence, in further embodiments the system 1000 may comprise an interconnect, wherein the interconnect is arranged between the luminescent body 200 and the contact region 406. Hence, the interconnect may be thermally coupled to the luminescent body 200 and to the contact region 406.

The chamber 450 may (during operation) comprise a (cooling) liquid 430. The liquid may especially be selected from the group comprising carbon dioxide (≤30° C.), methane (−≤−100° C.), nitrogen (≤−160° C.), acetone (−48° C. to 125° C.), ammonia (−75° C. to 125° C.), ethane, methanol (−75° C. to 120° C.), methylamine (−90° C. to 125° C.), pentane (−125° C. to 125° C.), propylene (−150° C. to 60° C.), water (1° C. to 325° C.), cesium, NaK, potassium, sodium, and lithium, especially one or more of acetone (−48° C. to 125° C.), ammonia (−75° C. to 125° C.), ethane, methanol (−75° C. to 120° C.), methylamine (−90° C. to 125° C.), pentane (−125° C. to 125° C.), propylene (−150° C. to 60° C.), water (1° C. to 325° C.). In further embodiments, the liquid 430 may especially comprise water. Water may be particularly advantageous as it may facilitate transferring a relatively large amount of energy.

In the depicted embodiment, the system 1000 further comprises a light generating device 100, especially a laser-based light generating device 100, configured to provide light source light 101 to the luminescent body 200. In particular, the luminescent body 200, especially the luminescent material 210, may be configured to convert at least part of the light source light 101 into luminescent material light 211. Hence, the system 1000 may provide system light 1001, which may comprise luminescent material light 211 and (optionally) light source light 101.

In embodiments, the two-phase cooling device 400, especially the tapering section 405, may taper to the contact region 406 at a tapering angle $\alpha_t$. The tapering angle $\alpha_t$ may especially be the (smallest) angle between a plane defined by the tapering section 405 and a plane defined by the second section 420. In particular, the tapering angle $\alpha_t$ may be the (smallest) (average) angle between (i) a plane defined by the tapering section 405 and (ii) the device axis A. The tapering angle $\alpha_t$ may especially be selected from the range of 20°-60°.

In the depicted embodiment, the device wall 410 has a first face 411 and a second face 412, wherein the first face 411 is directed to the chamber 450 and the second face 412 is directed to the external of the two-phase cooling device 400. Especially, (at least part of) the first face 411 comprised by the tapering section 405, especially (at least part of) the first face 411 comprised by the contact region 406, has a surface roughness ≤25 nm.

In further embodiments, the device wall 410 may comprise a second section 420, especially wherein the tapering section 405 and the second section 420 together define the device wall 410. At the second section 420 the device wall 410 may have a second thickness $d_2$ selected from the range of ≥0.4 mm. In particular, wherein $d1/d2 \leq 0.8$ In particular, the first face 411 at the tapering section 405 may have a lower surface roughness than the first face 411 at the second section 420.

In embodiments, the chamber 450 may be hollow, i.e., the chamber 450 may be devoid of a wick structure. The chamber 450 may, however, as will be clear to the person skilled in the art, comprise a (cooling) liquid 430, especially during operation.

In the depicted embodiment, the two-phase cooling device 400 comprises a second contact region 426 arranged opposite of the contact region 406, especially at a second end 402 of the two-phase cooling device along the device axis A. The system 1000 may further comprise or be functionally coupled to a heat exchanger 600, especially wherein the second contact region 426 is thermally coupled to the heat exchanger 600. Hence, the two-phase cooling device 400 may transfer heat from the luminescent body 200 to the heat exchanger 600.

In embodiments, the system 1000 may further comprise a control system 300. The control system 300 may be configured to control the system 1000, especially control one or more of the light generating device 100, the heat exchanger 600, and the pressure control element 500, especially the light generating device 100. The control system 300 may be configured to control any aspect of the operation of the controlled elements. In particular, the control system 300 may control the (operational) power of the light generating device 100. Further, the control system 300 may control a thermal transfer capacity of the heat exchanger 600, such as by controlling the amount of a liquid flowing through the heat exchanger 600. In embodiments, the control system 300 may further control the external air pressure provided by the pressure control element 500.

In the depicted embodiment, the system 1000 further comprises a temperature sensor 310. The temperature sensor 310 may be configured to determine a (surface or core) temperature of the luminescent body 200, and especially to provide a temperature-related signal to the control system 300. In such embodiments, the control system may be configured to control the (surface or core) temperature of the luminescent body 200 by controlling the light generating device 100 and/or the heat exchanger, especially the light generating device, or especially the heat exchanger.

Figure 1B:
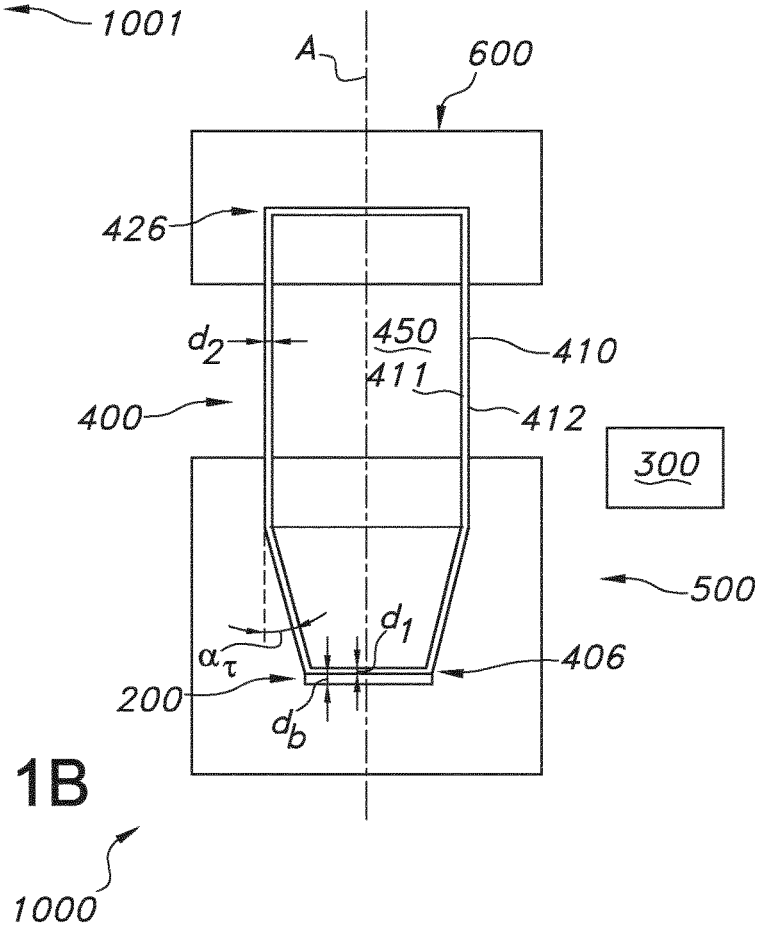

FIG. 1B schematically depicts an embodiment of the system 1000, wherein a chamber gas pressure $p_c$ in the chamber 450 is selected from the range of 0.1-0.5 bar. In the depicted embodiment, the system 1000 further comprises a pressure control element 500, wherein the pressure control element 500 is configured to control the external air pressure in the range of $1*p_c$-$1.2*p_c$. In particular, the pressure control element 500 may control the external air pressure the tapering section 405, especially the contact region 406, is exposed to.

In the depicted embodiment, the luminescent body may have a body thickness $d_b$, especially perpendicular to a plane defined by the contact region, such as parallel to the device axis A, wherein the body thickness $d_b \leq 2$ mm, such as ≤1 mm, especially ≤0.8 mm, such as ≤0.6 mm, especially ≤0.5 mm.

Figure 1C:
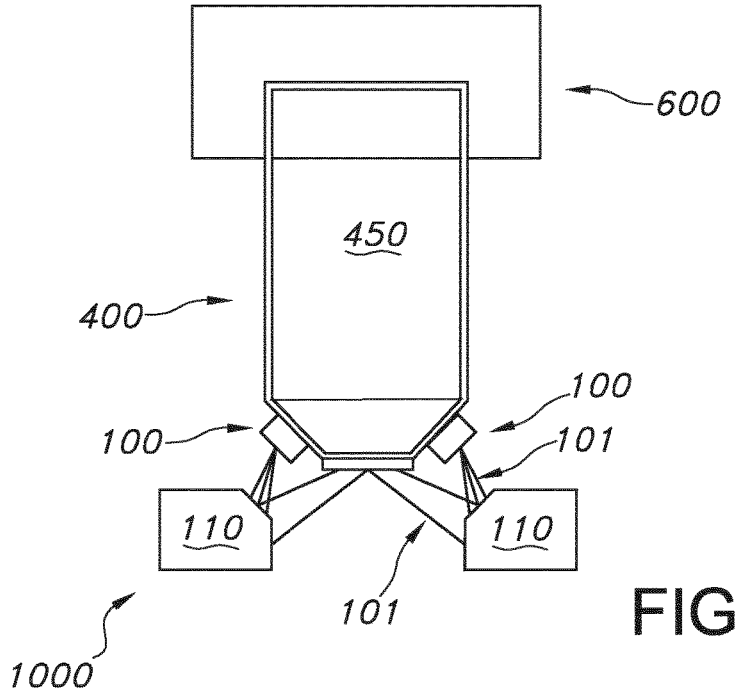

FIG. 1C schematically depicts an embodiment of the system 1000, wherein the system comprises a light generating device 100 and an optical element 110, wherein the light generating device 100 is thermally coupled to the two-phase cooling device 1000, especially to the tapering region 405. In further embodiments, the light generating device 100 may be thermally coupled to the contact region 406. In particular, the light generating device 100 is configured to provide light source light 101 to the optical element 110, especially wherein the optical element 110 is configured to redirect the light source light 101 to the luminescent body 200. The optical element 110 may especially comprise focusing optics, more especially reflective focusing optics.

In embodiments, the luminescent body 200 may comprise a luminescent material 210. The luminescent body 200 may especially be configured in a light receiving relationship with the light generating device 100, such as via the optical element 110. The luminescent material 210 may be configured to convert at least part of the (laser) light source light 101, e.g. blue light, into luminescent material light 211, e.g. yellow light.

Figure 1D:
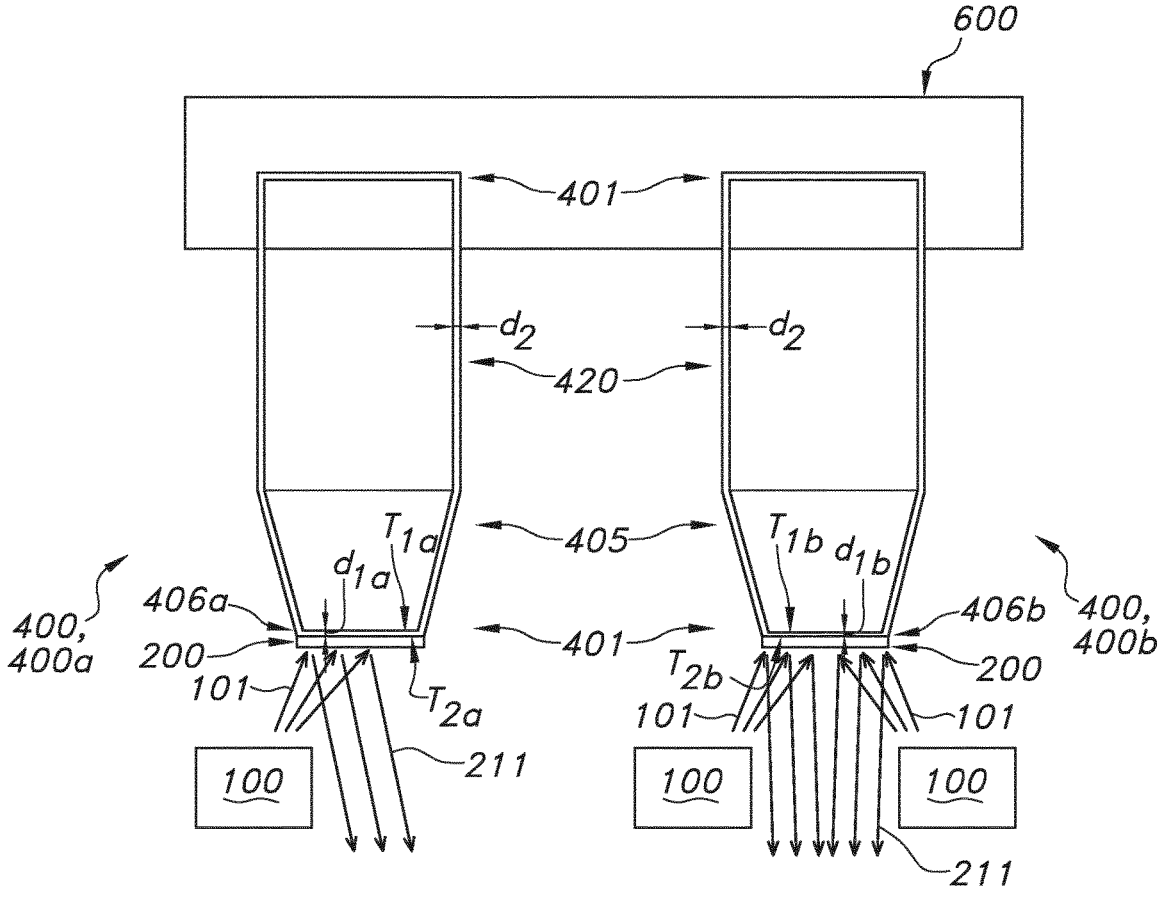

FIG. 1D schematically depicts an embodiment of the system 1000, wherein the system 1000 comprises two two-phase cooling devices 400 coupled to a single heat exchanger 600. In the depicted embodiment, a first two-phase cooling device 400*a* is coupled to a single light generating device 100, whereas a second two-phase cooling device 400*b* is coupled to two light generating devices 100. Hence, the luminescent body 200 of the second two-phase cooling device 400*b* may be exposed to a larger amount of light source light 101 and may generate more heat. Hence, the second two-phase cooling device 400*b* may at a second device contact region 406*b* have a second device first thickness $d_{1b}$ which is smaller than a first device first thickness $d_{1a}$ of the first two-phase cooling device 400*a* at a first device contact region 406*a*. The smaller thickness may provide a smaller ΔT between opposing sides of the contact region, i.e., $T_{2b}-T_{1b}<T_{2a}-T_{1a}$, which may enable the second two-phase cooling device 400*b* to provide a higher heat transfer than the first two-phase cooling device, despite both two-phase cooling devices 400 being coupled to the same heat exchanger 600.

Hence, in embodiments, the system may comprise two or more two-phase cooling devices 400, wherein at least two of the two or more two-phase cooling devices are thermally coupled to different heat sources, and wherein the at least two of the two or more two-phase cooling devices have different first thicknesses. Systems comprising multiple two-phase cooling devices 400 with different first thickness $d_1$ may, for example, be beneficial when different heat sources generate varying amounts of heat, or when the (core) temperature of the different heat sources is to be controlled at different temperatures.

FIGS. 2A-D and FIGS. 3A-B schematically depict simulated results corresponding to embodiments of the system 1000. In particular, for the simulations, the device wall 410 comprises copper, which may have a mechanical limit of 258 MPa. However, in general practice, it may be desirable not to push the device wall to its' theoretical limits, and to aim for a lower mechanical stress such as a limit of 210 MPa (used for FIG. 2A-2D) or 180 MPa (used for FIG. 3A-B).

In particular, the simulations were fine element method (FEM) thermal simulations performed with Solidworks. The model was parameterized according to: a luminescent body with a diameter of 3.6 mm; an inner tube diameter (of the two-phase cooling device) of 9.2 mm; a second thickness $d_2$ of 0.4 mm; a taper length of 7.6 mm (defined along the device axis); a first thickness $d_1$ in the range of 0.1 mm till 0.4 mm; a device wall comprising copper with a thermal conductivity of 400 W/mK; the second section comprises copper and is functionally coupled to a fixed heat sink temperature of 50° C.; the liquid is water; the chamber has a thermal conductivity of 100.000 W/mK to represent the dual liquid gas stage to mimic the internal two-phase cooling device; the length of the two-phase cooling device (along the device axis) was set at 400 mm.

Figure 2A:
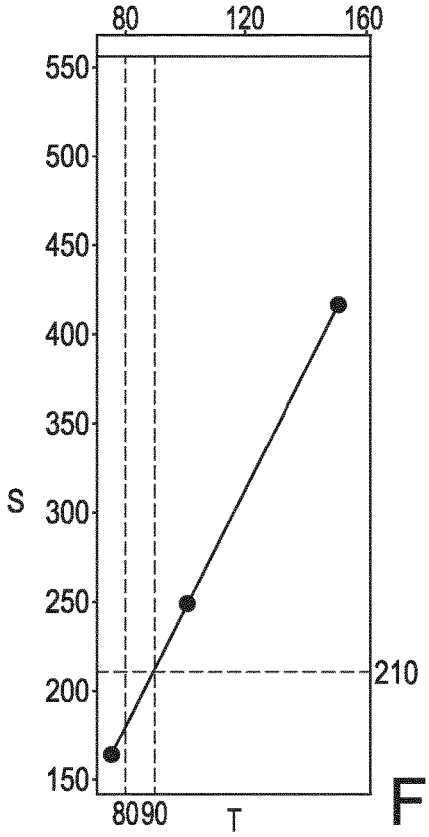
FIG. 2A-D schematically depict results of experimental simulations of embodiments of the system.
Figure 2B:
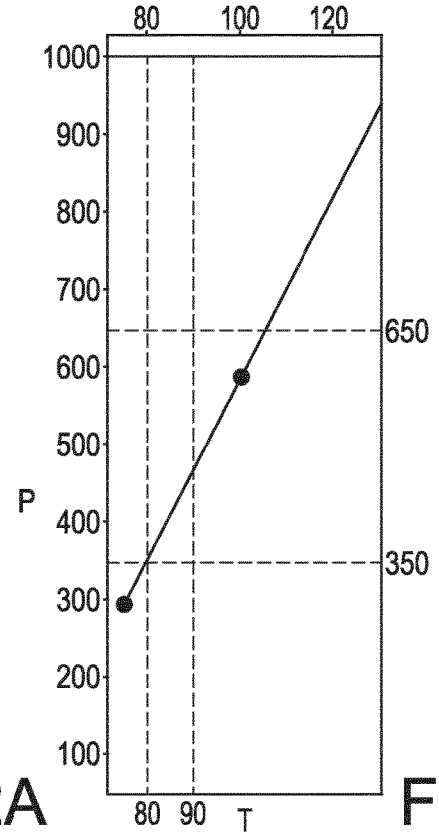
Figure 2C:
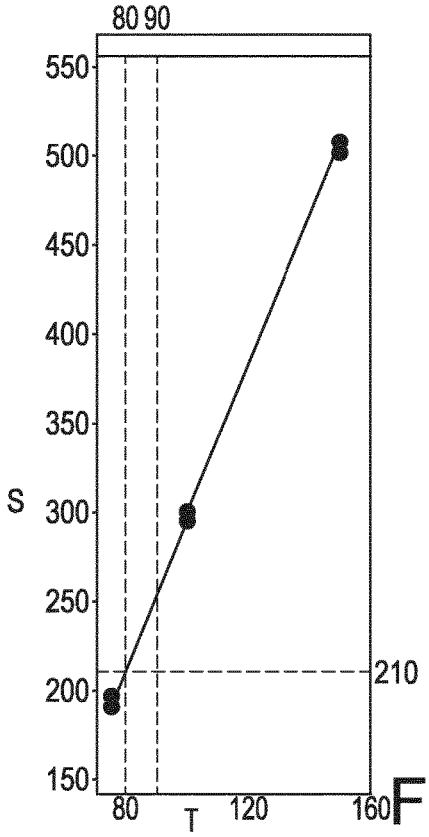
Figure 2D:
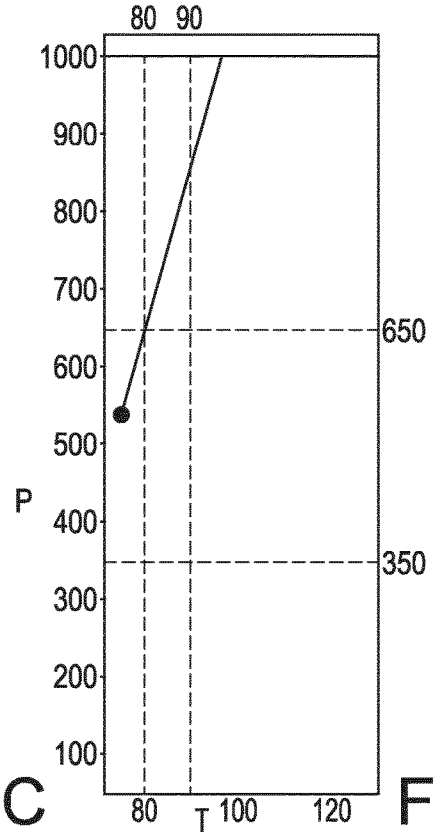

FIG. 2A-B relate to a system 1000 having a contact region 406 with a first thickness $d_1$=0.4 mm. FIG. 2C-D relate to a system 1000 having a contact region 406 with a first thickness $d_1$=0.2 mm. FIG. 2A and FIG. 2C depict the material stress S in MPa imposed on the system 1000, especially imposed on the contact region 406, as a function of the temperature T in ° C. The horizontal line at 210 MPa indicates the selected upper limit for mechanical stress. Hence, for the system 1000 with $d_1$=0.4 mm, the max temperature may be about 90° C., whereas for the system 1000 with $d_1$=0.2 mm, the max temperature may be about 80° C. FIG. 2B and FIG. 2D then depict the max power transfer P in W as a function of the temperature T in ° C. Hence, for the system 1000 with $d_1$=0.4 mm, the max power transfer P may be about 350 W at 80° C. or around 450 W at 90° C., whereas for the system 1000 with $d_1$=0.2 mm the max power transfer P may be about 650 W at 80° C. Hence, the system 1000 with a lower $d_1$ may have a lower temperature limit due to mechanical stress, but may facilitate a higher max power transfer P at a given temperature. In particular, the system 1000 with a lower $d_1$ may have a higher max power transfer P at the respective temperature limits.

Figure 3A:
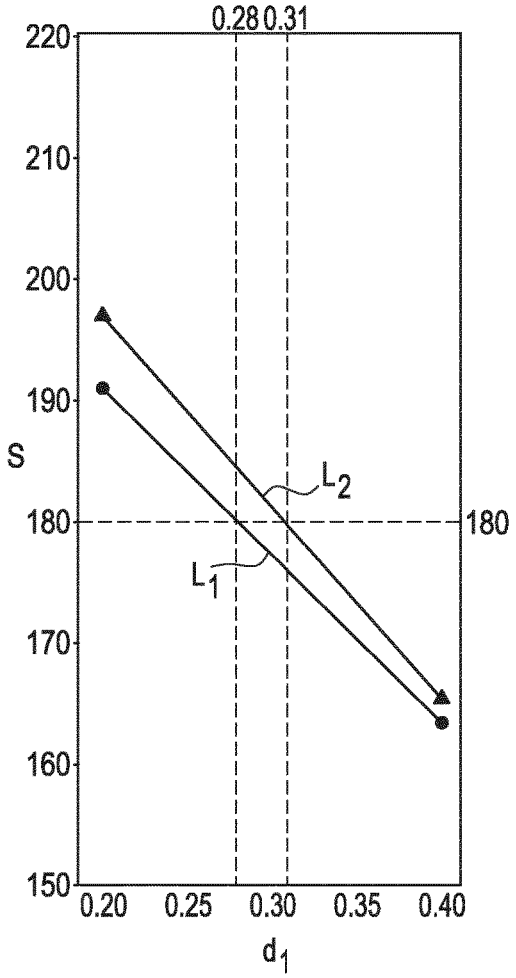
FIG. 3A-B schematically depict results of experimental simulations of embodiments of the system.
Figure 3B:
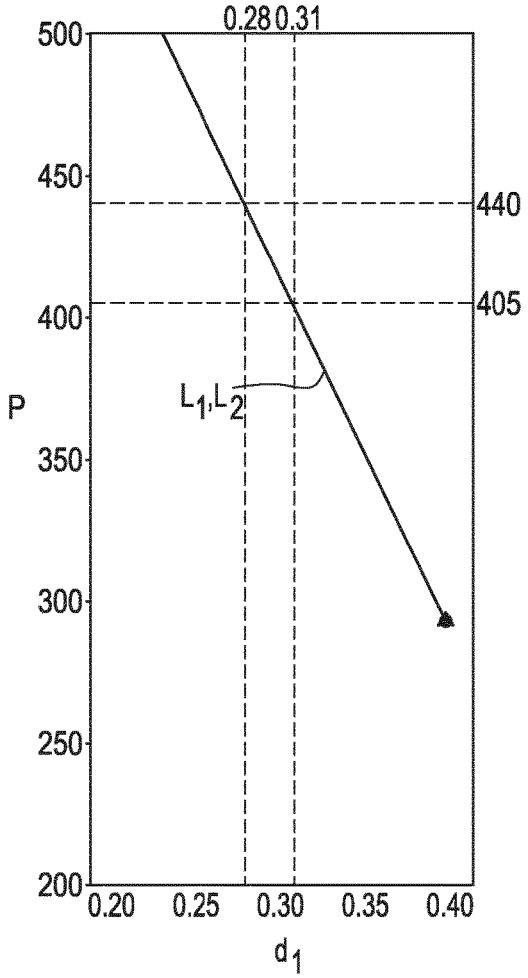

FIG. 3A-B schematically depict simulations of the system 1000 wherein the surface temperature of the luminescent body 200 (of the surface directed towards the two-phase cooling device 400) is set at 75° C. In particular, the simulations are performed for a system 1000 comprising a pressure control element 500 configured to provide a pressure difference between the chamber 450 and the external air pressure the contact region 406 is exposed to of 0.1 bar (line $L_2$) or 0.0 bar (line $L_1$).

FIG. 3A schematically depicts the mechanical stresses in MPa on the system 1000 as a function of the first thickness $d_1$. Hence, at each first thickness $d_1$, the system 1000 operating at a reduced pressure difference may impose a lower mechanical stress on the two-phase cooling device 400, allowing to further reduce $d_1$ for a given max mechanical stress. In FIG. 3B the max mechanical stress is, for example, set at 180 MPa, in view of the safety factors applied for the material application, as is represented by the horizontal line at 180 MPa. Hence, the embodiment of the system 1000 with the pressure difference of 0.1 has a lower boundary for the first thickness of 0.31 mm, whereas the system 1000 with the pressure difference of 0.0 has a lower boundary for the first thickness of 0.28 mm. FIG. 3B schematically depicts the max power transfer P in W versus the first thickness $d_1$. As the pressure difference does not directly affect the max power transfer P the lines $L_1$ and $L_2$ overlap. The system 1000 operating with a first thickness $d_1$ of 0.31 mm thus has a max power transfer P of 405 W, whereas the system 1000 operating at a first thickness $d_1$ of 0.28 mm has a max power transfer P of 440 W. Hence, the pressure control element 500 may be configured to reduce a pressure difference between the chamber 450 and the external air pressure (i.e., external to the two-phase cooling device 400) in order to allow for a two-phase cooling device 400 with a reduced first thickness $d_1$, which may in turn facilitate a higher max power transfer P.

Figure 4:
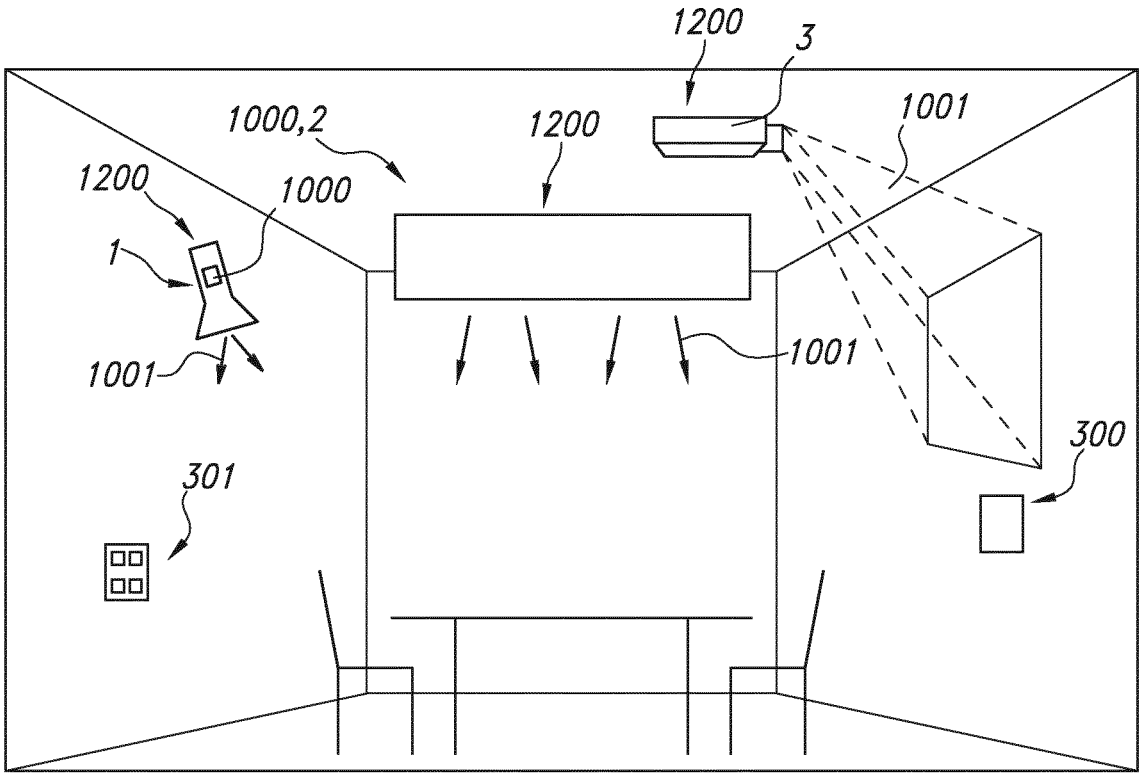
FIG. 4 schematically depicts embodiments of a light generating system comprising the system. The schematic drawings are not necessarily on scale.

FIG. 4 schematically depicts embodiments of the light generating system 1200. The light generating system 1200 may especially comprise a lamp 1, a luminaire 2, or projector device 3, comprising the system 1000 as described herein, and providing system light 1001. FIG. 4 schematically depicts an embodiment of a luminaire 2 comprising the system 1000 as described above. Reference 301 indicates a user interface which may be functionally coupled with the control system 300 comprised by or functionally coupled to the system 1000. FIG. 4 also schematically depicts an embodiment of a lamp 1 comprising the system 1000. Reference 3 indicates a projector device 3 or projector system comprising the system 1000, which projector device 3 may be used to project images, such as at a wall.

In further embodiments, the light generating system 1200 may comprises a plurality of systems 1000, especially wherein two-phase cooling devices 400 of (at least) two of the plurality of systems 1000 have different first thicknesses $d_1$. The two-phase cooling devices 400 with different first thicknesses $d_1$ may especially be thermally coupled to different (types of) heat sources of the light generating system 1200. Of course, more than two two-phase cooling devices 400 may be available, and two or more of two or more two-phase cooling devices 400 may also in other specific embodiments have the same first thicknesses $d_1$.

In further A light generating system 1200 selected from the group of a lamp 1, a luminaire 2, a projector device 3, a disinfection device, and an optical wireless communication device, comprising the system 1000 according to any one of the preceding claims.

The term "plurality" refers to two or more. Furthermore, the terms "a plurality of" and "a number of" may be used interchangeably.

The terms "substantially" or "essentially" herein, and similar terms, will be understood by the person skilled in the art. The terms "substantially" or "essentially" may also include embodiments with "entirely", "completely", "all", etc. Hence, in embodiments the adjective substantially or essentially may also be removed. Where applicable, the term "substantially" or the term "essentially" may also relate to 90% or higher, such as 95% or higher, especially 99% or higher, even more especially 99.5% or higher, including 100%. Moreover, the terms "about" and "approximately" may also relate to 90% or higher, such as 95% or higher, especially 99% or higher, even more especially 99.5% or higher, including 100%. For numerical values it is to be understood that the terms "substantially", "essentially", "about", and "approximately" may also relate to the range of 90%-110%, such as 95%-105%, especially 99%-101% of the values(s) it refers to.

The term "comprise" also includes embodiments wherein the term "comprises" means "consists of".

The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices, apparatus, or systems may herein amongst others be described during operation. As will be clear to the person skilled in the art, the invention is not limited to methods of operation, or devices, apparatus, or systems in operation.

The term "further embodiment" and similar terms may refer to an embodiment comprising the features of the previously discussed embodiment, but may also refer to an alternative embodiment.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim.

Use of the verb "to comprise" and its conjugations does not exclude the presence of elements or steps other than those stated in a claim. Unless the context clearly requires otherwise, throughout the description and the claims, the words "comprise", "comprising", "include", "including", "contain", "containing" and the like are to be construed in an inclusive sense as opposed to an exclusive or exhaustive sense; that is to say, in the sense of "including, but not limited to". The article "a" or "an" preceding an element does not exclude the presence of a plurality of such elements.

The invention may be implemented by means of hardware comprising several distinct elements, and by means of a suitably programmed computer. In a device claim, or an apparatus claim, or a system claim, enumerating several means, several of these means may be embodied by one and the same item of hardware. The mere fact that certain measures are recited in mutually different dependent claims does not indicate that a combination of these measures cannot be used to advantage.

The invention also provides a control system that may control the device, apparatus, or system, or that may execute the herein described method or process. Yet further, the invention also provides a computer program product, when running on a computer which is functionally coupled to or comprised by the device, apparatus, or system, controls one or more controllable elements of such device, apparatus, or system.

The invention further applies to a device, apparatus, or system comprising one or more of the characterizing features described in the description and/or shown in the attached drawings. The invention further pertains to a method or process comprising one or more of the characterizing features described in the description and/or shown in the attached drawings. Moreover, if a method or an embodiment of the method is described being executed in a device, apparatus, or system, it will be understood that the device, apparatus, or system is suitable for or configured for (executing) the method or the embodiment of the method, respectively.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A system comprising (i) a luminescent body and (ii) a two-phase cooling device, wherein the two-phase cooling device has a device wall, wherein the device wall defines a chamber, wherein the device wall comprises a tapering section comprising a contact region, wherein the tapering section tapers to the contact region, wherein the luminescent body is thermally coupled to the contact region, wherein the device wail has a first thickness $d_1$ at the contact region, wherein $d_1$ is selected from the range of 0.15-0.35 mm, and wherein the device wall comprises a second section, wherein the tapering section and the second section together define the device wall, and wherein the device wall at the second section has a second thickness d2≥0.4 mm.

2. The system according to claim 1, wherein the system further comprises a light generating device configured to provide light source light to the luminescent body, wherein the luminescent body comprises luminescent material configured to convert at least part of the light source light into luminescent material light.

3. The system according to claim 1, wherein the tapering section tapers to the contact region at a tapering angle $\alpha_t$ selected from the range of 20°-60°.

4. The system according to claim 1, wherein the device wall has a first face and a second face, wherein the first face is directed to the chamber and the second face is directed to the external of the two-phase cooling device, wherein at least part of the first face comprised by the tapering section has a surface roughness ≤120 nm.

5. The system according to claim 1, wherein the device wall comprises a thermally conductive material selected from the group comprising copper, aluminum, stainless steel, nickel, and titanium.

6. The system according to claim 1, wherein the luminescent body has a body thickness $d_b$ perpendicular to a plane defined by the contact region, wherein the body thickness $d_b$≤2mm.

7. The system according to claim 1, wherein the contact region has a contact area $a_c$ selected from the range of 1-100 $mm^2$, and wherein the two-phase cooling device has a device axis (A), and wherein the two-phase cooling device has an average cross-sectional area $a_m$ perpendicular to the device axis (A), wherein $a_c \leq 0.7 * a_m$, and wherein the chamber is hollow.

8. The system according to claim 1, wherein a chamber gas pressure $p_c$ in the chamber is selected from the range of 0.1-0.5 bar, wherein the system comprises a pressure control element, wherein the contact region is exposed to an external air pressure, wherein the pressure control element is configured to control the external air pressure in the range of $0.9 * p_c$-$1.3 * p_c$.

9. The system according to claim 1, wherein the two-phase cooling device comprises a second contact region arranged opposite of the contact region, wherein the system further comprises a heat exchanger, wherein the second contact region is thermally coupled to the heat exchanger, and wherein the chamber has a volume ≥1 $cm^3$.

10. The system according to claim 2, wherein the light generating device is thermally coupled to the two-phase cooling device.

11. The system according to claim 2, wherein the system further comprises a control system and a temperature sensor, wherein the temperature sensor is configured to determine a core temperature of the luminescent body and to provide a temperature-related signal to the control system, and wherein the control system is configured to control the core temperature of the luminescent body in the range of ≤200° C. by controlling the light generating device.

12. The system according to claim 1, wherein the two-phase cooling device comprises a heat pipe or a vapor chamber.

13. The system according to any one of the preceding claim 1, wherein the light generating device comprises a laser.

14. A light generating system selected from the group of a lamp, a luminaire, a projector device, a disinfection device, and an optical wireless communication device, comprising the system according to claim 1.

15. The light generating system according to claim 14, wherein the light generating system comprises a plurality of systems, wherein two-phase cooling devices of at least two of the plurality of systems have different first thicknesses $d_1$.

* * * * *